US006536519B1

(12) United States Patent
Vaynshteyn et al.

(10) Patent No.: US 6,536,519 B1
(45) Date of Patent: Mar. 25, 2003

(54) DOWNHOLE TOOL TO GENERATE TENSION PULSES ON A SLICKLINE

(75) Inventors: Vladimir Vaynshteyn, Sugar Land, TX (US); Matthew Sweetland, Somerville, MA (US); Christian C. Spring, Houston, TX (US)

(73) Assignee: Schlumberger Technology Corp., Rasharon, TX (US)

( * ) Notice: Subject to any disclaimer, the term of this patent is extended or adjusted under 35 U.S.C. 154(b) by 0 days.

(21) Appl. No.: 09/687,273

(22) Filed: Oct. 13, 2000

(51) Int. Cl.[7] ..... E21B 4/08; E21B 47/09; E21B 47/14

(52) U.S. Cl. ..... 166/64; 166/66.4; 166/250.13; 73/152.56; 73/152.59

(58) Field of Search ..... 166/255.1, 255.2, 166/373, 381, 64, 113, 250.01, 250.13, 66, 66.4, 66.5, 66.6, 66.7, 75.14; 73/152.01, 152.54, 152.56, 152.59

(56) References Cited

U.S. PATENT DOCUMENTS

| | | | | |
|---|---|---|---|---|
| 3,019,841 A | * | 2/1962 | Ternow | 166/65.1 |
| 3,991,610 A | | 11/1976 | Rakar et al. | |
| 4,252,190 A | * | 2/1981 | Jageler et al. | 166/250.01 |
| 4,519,585 A | * | 5/1985 | Furrow | 254/273 |
| 4,896,722 A | | 1/1990 | Upchurch | |
| 4,932,471 A | * | 6/1990 | Tucker et al. | 166/113 |
| 5,117,398 A | * | 5/1992 | Jeter | 367/85 |
| 5,167,278 A | * | 12/1992 | Goldschild | 166/113 |
| 5,269,374 A | * | 12/1993 | Taylor | 166/113 |
| 5,351,531 A | | 10/1994 | Kerr | |
| 5,361,838 A | | 11/1994 | Kilgore | |
| 5,377,540 A | * | 1/1995 | Songe et al. | 166/255.1 |
| 5,429,190 A | | 7/1995 | Kilgore et al. | |
| 5,495,755 A | * | 3/1996 | Moore | 166/254.2 |
| 5,585,555 A | * | 12/1996 | McRae | 166/250.01 |
| 5,608,214 A | | 3/1997 | Baron et al. | |
| 5,740,127 A | * | 4/1998 | Van Steenwyk et al. | 175/40 |
| 6,084,403 A | * | 7/2000 | Sinclair et al. | 166/255.1 |
| 6,318,463 B1 | * | 11/2001 | Fehrmann et al. | 166/250.03 |

FOREIGN PATENT DOCUMENTS

| | | | | |
|---|---|---|---|---|
| EP | 0697497 A1 | * | 2/1996 | E21B/47/09 |

OTHER PUBLICATIONS

Petroleum Engineering Services Limited, *Slickline Initiation Device*, Product No.—320 IC dated Oct. 4, 1995, 12 pages.
Halliburton, *Unparalleled Slickline Depth Correlation*, dated Apr. 1998, 4 pages.
Halliburton, *Advanced Measurement System*, dated 1995 and 1997, 5 pages.

* cited by examiner

*Primary Examiner*—David Bagnell
*Assistant Examiner*—Jennifer H Gay
(74) *Attorney, Agent, or Firm*—Trop, Pruner & Hu; Jeffrey Griffin; Brigitte Jeffery

(57) ABSTRACT

A downhole tool that is connectable to a line to be run downhole with the tool includes a housing, a sensor and a mechanism that is located inside the housing. The mechanism is coupled to the sensor to, in response to the detection of the feature by the sensor, generate a tension signal in the line without physically contacting a downhole structure.

32 Claims, 8 Drawing Sheets

DOWNHOLE TOOL TO GENERATE TENSION PULSES ON A SLICKLINE

BACKGROUND

The invention relates to a downhole tool to generate tension signals on a slickline.

Certain downhole oilfield applications, such as perforating applications, require the ability to be able to position a tool at a particular and known spot in the well. For example, a slickline service uses a slickline tool assembly that is lowered downhole via a slickline. A depth counter may be used to track the length of the dispensed slickline to approximate the depth of the slickline tool assembly. However, because the depth counter does not precisely indicate the depth, other techniques may be used.

For example, a more precise technique may use a depth control log (a gamma ray log, for example), a log that is run while drilling the well and indicates the depths of various casing collars of the well. In this manner, the slickline tool assembly may be run downhole and include a detection device to detect casing collars. When the detection device indicates detection of a casing collar, the coarse depth that is provided by the depth counter may be used to locate the corresponding casing collar on the depth control log. Because the depth control log precisely shows the depth of the detected casing collar, the precise depth of the tool assembly may be determined. From this determination, an error compensation factor may be derived. Then, when a perforating gun is lowered downhole, the error compensation factor is used to compensate the reading of the depth counter to determine the position of the gun. Unfortunately, the error may not be the same, because more or less line may be dispensed than was dispensed when the error compensation factor was derived. Thus, more strain on the line may cause the compensation that is provided by the error compensation factor to be inaccurate.

The slickline tool assembly does not have the benefit of electrical communication with the surface of the well. Instead, the slickline tool assembly may generate tension pulses on the slickline to indicate the detection of a casing collar. To accomplish this, the conventional slickline tool assembly may perform some sort of physical interaction with a well casing. For example, the slickline tool assembly may include a mechanical drag device to generate the tension pulses. As an example, the mechanical drag device may be an end of a tubing locator, a device that includes a set of arms that extend to make contact with the well casing when the tool initially passes the end of the tubing of a mule shoe. In this manner, when the slickline operator attempts to pull back into the tubing, the arms catch on the restriction and do not close until a certain amount of tension is applied to the end of the tubing. This catch and release sequence creates a tension pulse on the slickline. This technique may be risky if the end of tubing locator does not release, a condition that may cause the tool assembly to become lodged in the well. Furthermore, the well may not have a suitable profile to permit proper operation of the end of tubing locator.

Thus, there is a continuing need for an arrangement that allows real time depth indication at multiple points while running a particular downhole tool (a perforating gun, for example).

SUMMARY

In an embodiment of the invention, a downhole tool that is connectable to a line to be run downhole with the tool includes a housing, a sensor and a mechanism that is located inside the housing. The mechanism is coupled to the sensor to, in response to the detection of the feature by the sensor, generate a tension signal in the line without physically contacting a downhole structure.

Advantages and other features of the invention will become apparent from the following description, from the drawing and from the claims.

DETAILED DESCRIPTION

Figure 1:
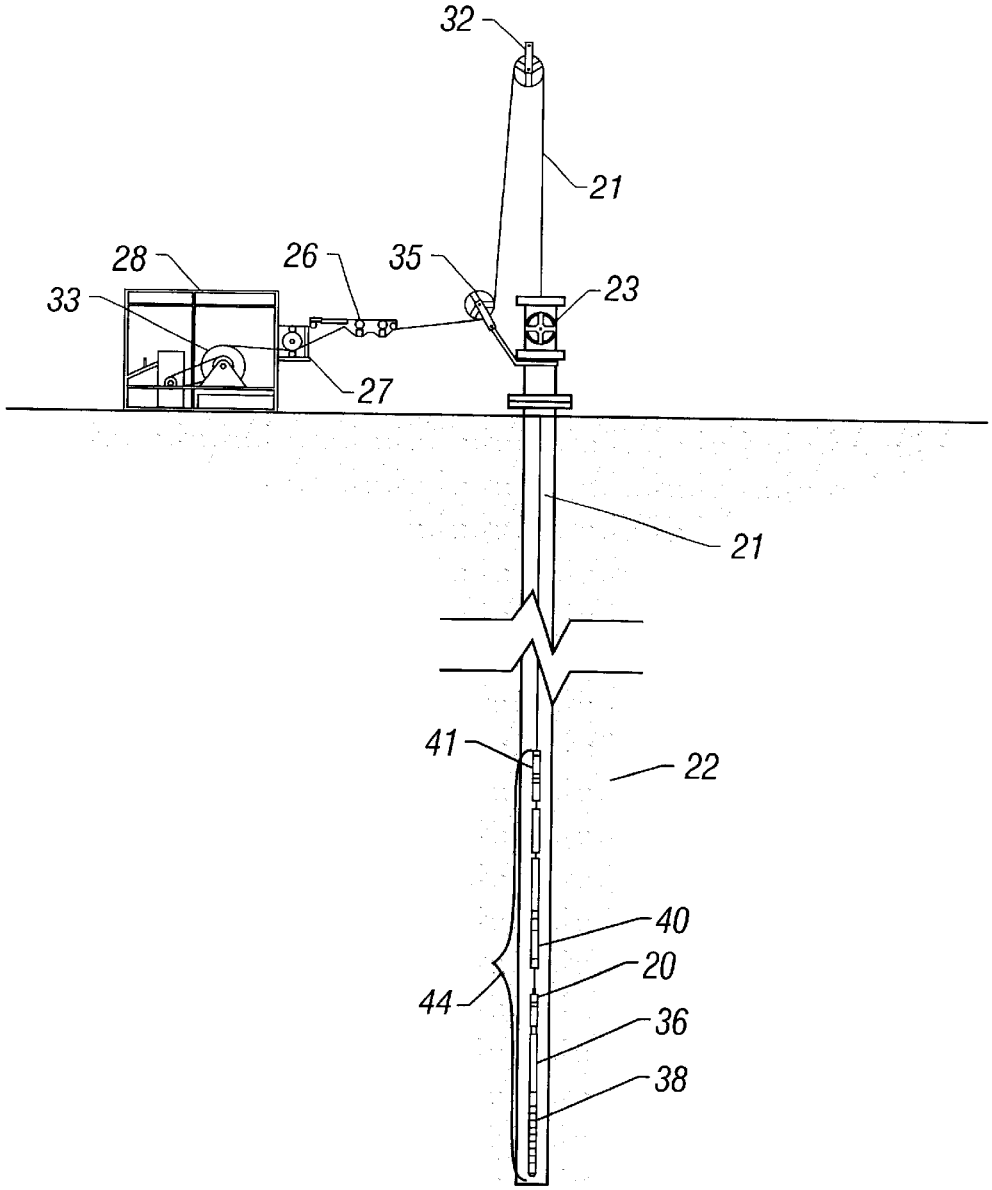
FIG. 1 is a schematic diagram of a slickline system.
Figure 2:
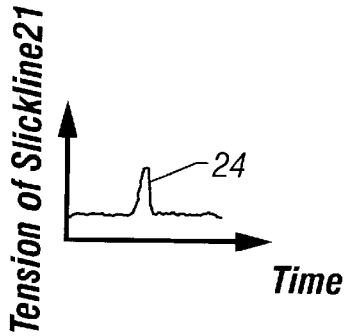
FIG. 2 is a waveform illustrating tension of a slickline of the system of FIG. 1.

Referring to FIGS. 1 and 2, an embodiment 44 of a slickline downhole tool assembly in accordance with the invention includes a pulse generator tool 20 that is constructed to generate a tension pulse 24 in a slickline 21 when the tool 20 is in close proximity to a casing collar. The tool 20 generates the tension pulse 24 without requiring physical interaction with a well casing 22 that surrounds the tool assembly 44. Therefore, as a result of this arrangement, no exposed mechanical parts are needed to generate the tension pulse 24, and the risk of the tool assembly 44 becoming lodged downhole in the well is substantially reduced.

Besides the pulse generator tool 20, the tool assembly 44 may also include a hydraulic strain head 41 to receive command stimuli from a surface of the well (as described below), a jar 40 to aid in disloading the tool assembly 44 if the assembly 44 becomes lodged downhole, a firing head 36 and a perforating gun 38. In some embodiments, the tool 20 may generate the tension pulses 24 for purposes of precisely positioning the perforating gun 38.

The hydraulic strain head 41 may be used to instruct the tool 20 to start and/or stop generating tension pulses in response to observed casing collars. Because the interval in which the tension pulses are generated may be controlled via the hydraulic strain head 41, battery power may be conserved, as the number of unnecessary tension pulses is minimized. Furthermore, it is desirable to turn off the generation of the tension pulses before firing the perforating gun 38.

Figure 3:
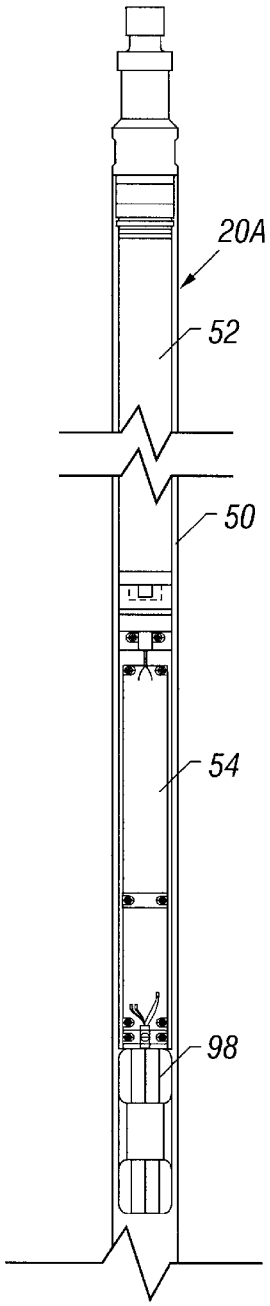
FIGS. 3, 4 and 5 are schematic diagrams illustrating a tool of the system of FIG. 1 according to an embodiment of the invention.
Figure 4:
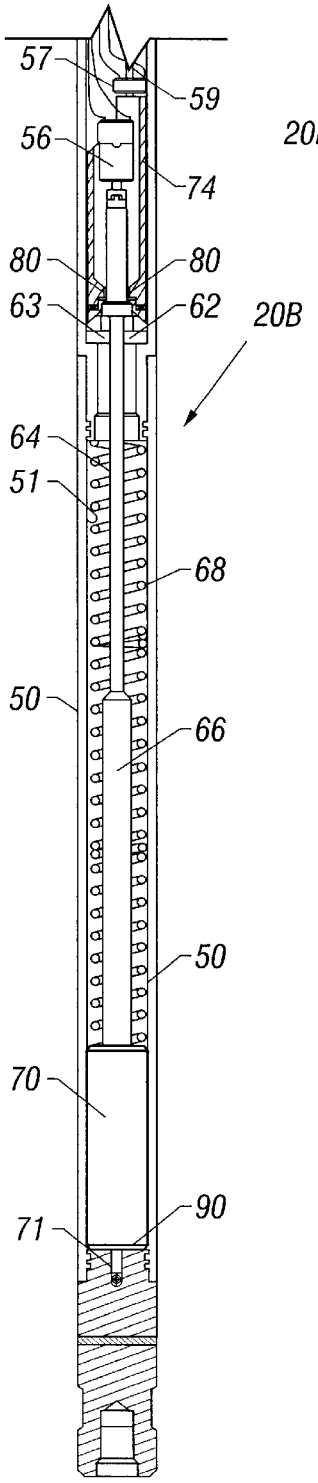
Figure 5:
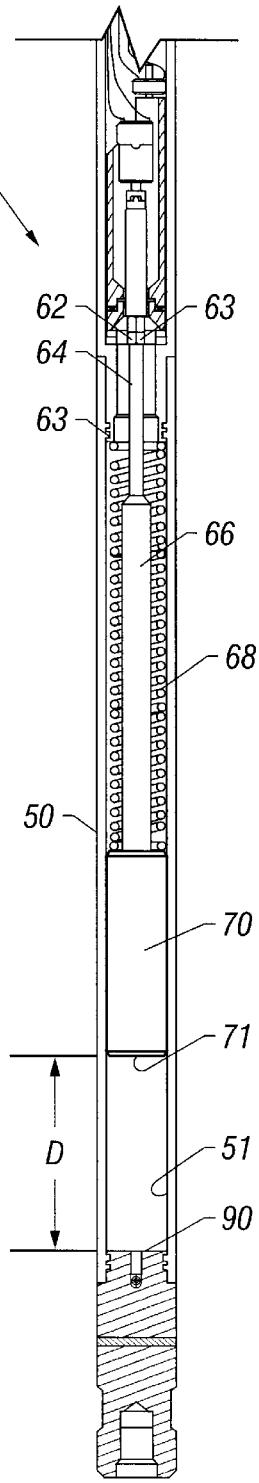

More particularly, FIG. 3 depicts an upper portion 20A of the tool 20; and FIGS. 4 and 5 depict a bottom portion 20B of the tool 20 for different states of the tool 20, as described below. As shown, the tool 20 includes a housing 50 that encases the components of the tool 20, such as a weight 70 (see FIGS. 4 and 5) that resides in an interior chamber 51 of the housing 50. In a first state (depicted in FIG. 5) of the tool 20, the weight 70 is held (as described below) in suspension over a contact surface 90 of the housing 50 by a latch, or brake (formed by a split collar 61 and a release shaft 74), that are described below. When a magnetic casing collar sensor 98 (see FIG. 3) of the tool 20 detects a casing collar, circuitry of the tool 20 causes the brake to release the weight 70, an action that causes the weight 70 to travel a distance d (see FIG. 5) and strike the surface 90 (see FIG. 4) to generate the tension pulse 24.

In some embodiments, the brake is designed to selectively grip a threaded shaft 64 (see FIGS. 4 and 5) that is coupled to the weight 70 to control the rise and fall of the weight 70. In this manner, the brake releases the shaft 64 to allow the weight 70 to fall and strike the surface 90, and the brake grips the shaft 64 so that the weight 70 may be retracted (as described below) back into its suspended position above the surface 90 in preparation for the generation of another tension pulse 24. The weight 70 is secured to a connecting rod 66 that couples the weight 70 to the threaded shaft 64. The threaded shaft 64, in turn, passes through a split collar 62 that, along with a release shaft 74 and the threaded shaft 64, form the brake.

Figure 6:
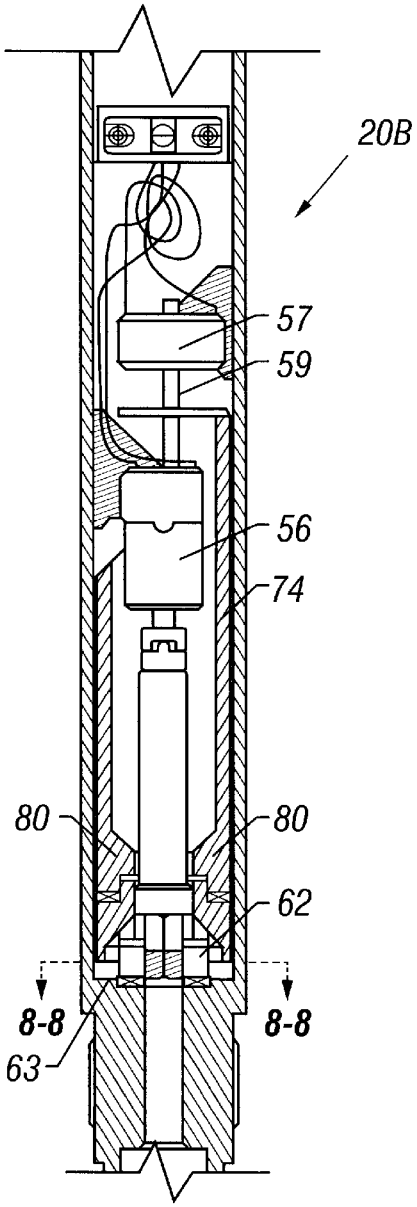
FIGS. 6 and 7 are more detailed schematic diagrams of the tool according to an embodiment of the invention.
Figure 7:
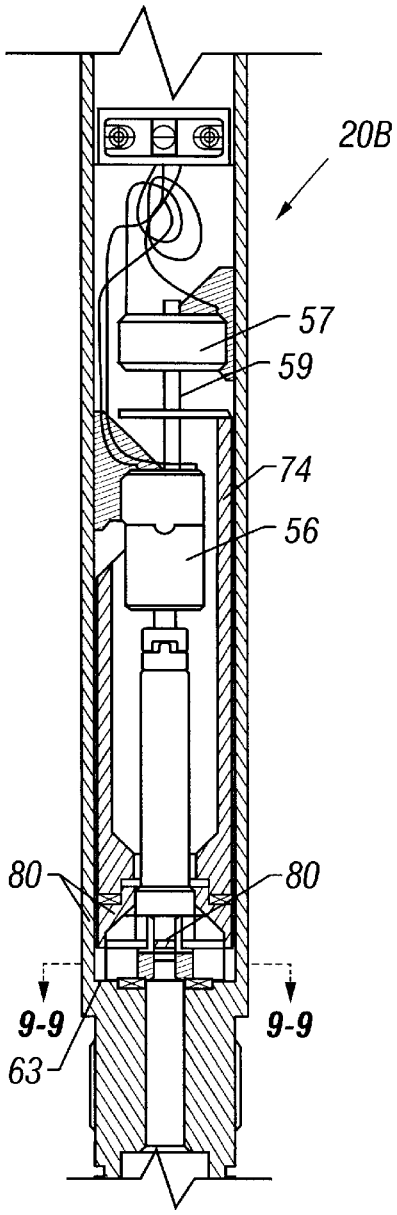

Referring also to FIGS. 6 and 7 (that do not depict the threaded shaft 64 for purposes of more clearly illustrating operation of the split collar 62), in some embodiments, the release shaft 74 is generally cylindrical and includes a release collar 80 near its lower end. The release collar 80 extends in a radial inward direction to operate the split collar 62 (as described below) to selectively grab and release the threaded shaft 64. In this manner, when the release shaft 74 is at its maximum point of downward travel, the release collar 80 compresses the split collar 62 to cause internal threads of the split collar 62 to grab the thread shaft 64, as depicted in FIG. 5. When the release shaft 74 moves in an upward direction, the release collar 80 moves away from the split collar 62, and due to the spring loaded release (described below) of the split collar 62, the split collar 62 releases its grip on the threaded shaft 62 and permits the weight 70 to fall and strike the surface 90.

In some embodiments, the tool 20 includes a solenoid 57 to control the upward and downward travel of the release shaft 74 and thus, control when the release collar 80 compresses the split collar 62 and when the release collar 80 permits the split collar 62 to expand. In this manner, the solenoid 57 is mounted to the housing 50 above the release shaft 74 and includes a shaft 59 (see FIGS. 6 and 7) that is attached to the release shaft 74. When the solenoid 57 retracts the release shaft 74 to a position above the split collar 62, the split collar 62 expands and releases the threaded shaft 64, as depicted in FIGS. 4 and 7. However, as depicted in FIGS. 5 and 6, when the solenoid 57 moves the release shaft 74 so that the release collar 80 compresses the split collar 62, a threaded connection is formed between the threaded shaft 64 and the split collar 62. Because the split collar 62 is prevented from rotating with respect to the housing 50, a screw drive is formed to raise the weight 70 back into its suspended position (see FIGS. 4 and 6). In some embodiments of the invention, a motor assembly 56 (that is attached to the housing 50) is coupled to the threaded shaft 64 via a drive shaft 60 to retract the weight 70 via the screw drive, as described below.

In some embodiments, the tool 20 may include a coiled spring 68 (see FIGS. 4 and 5) that surrounds the threaded shaft 64 and the connecting rod 66 and resides between a top surface of the weight 70 and an inwardly extending shoulder 63 (of the housing 50) on which the split collar 62 resides. Due to this arrangement, when the motor assembly 56 raises the weight 70, the spring 68 is compressed, as depicted in FIGS. 5 and 6. Therefore, when the split collar 62 releases the weight 70, the potential energy that is associated with the compressed spring 68 is converted into kinetic energy to cause a greater impact of the weight 70 against the surface 90 and thus, generate a more definite signature for the tension pulse 24.

Although, in some embodiments, the weight 70 may have a relatively flat bottom surface 71, in other embodiments, the surface 90 may be, for example, a conical surface that forms a point for striking the surface 90 of the housing 50. These variations in the surface 71 as well as the distance d in which the weight 70 travels when released may be varied to define different signatures for the tension signal 24.

In some embodiments, the magnetic sensor 98 generates an electronic pulse signal when the sensor 98 detects a casing collar. In response to the pulse of the electronic signal, the electronics 54 (see FIG. 3) of the tool 20 activate the solenoid 57 and motor assembly 56 accordingly to release the weight 70 and then to retract the weight 70 after the generation of the tension pulse 24. Among the other features of the tool 20, the tool 20 may include a battery 52 that provides energy to power, as examples, the electronics 54, motor assembly 56 and the solenoid 57. The electronics 54 may be coupled to the hydraulic strain head 41.

In some embodiments, a command may be communicated to the tool 20 (via the hydraulic strain head 41) to start generating the tension pulses 24 every time the magnetic sensor 98 detects a casing collar. These commands may be transmitted to the tool 20 via acceleration and deacceleration of the tool assembly 44, as detected by the hydraulic strain head 41 (see FIG. 1). In this manner, the tool 20 may be lowered to the bottom of the well, and then the command may be communicated downhole to instruct the tool 20 to begin generating the tension pulses 24 as the casing collars are detected. However, in other embodiments, an approximation of the tool depth may be performed by, for example, using a depth counter 27 (see FIG. 1) at the surface of the well to measure the length of the deployed slickline 21. Based on this rough estimation, the position of the tool 20 is coarsely determined, and then a command is sent to the tool 20 to begin the generation of the tension pulses 24 to finely adjust the position of the tool 20.

Figure 8:
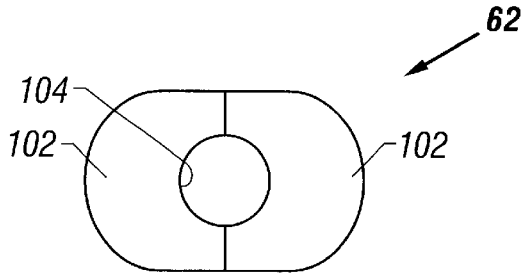
FIG. 8 is a cross-sectional view of a split collar of the tool taken along line 8—8 of FIG. 6.
Figure 9:
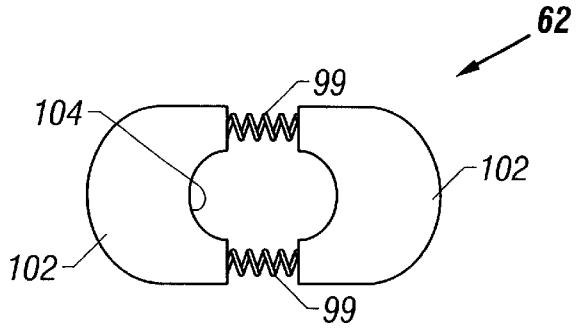
FIG. 9 is a cross-sectional view of the split collar of the tool taken along line 9—9 of FIG. 7.

Referring to FIG. 8, in its closed position, the split collar 62 includes two half sections 102 that when compressed, form a threaded interior cylinder 104 for receiving the threaded shaft 64. Referring also to FIG. 9, compression springs 99 are formed between the halves 102 to force the split collar 62 apart when the solenoid 57 moves the release shaft 74 to its upper point of travel.

Referring back to FIG. 1, the slickline tool assembly 44 is part of a slickline system that may include, as an example, a wellhead 23 that forms a seal with the slickline 21 at the surface of the well. The slickline 21 is attached to a drum 33 of a slickline unit 28 at the surface of the well. In this manner, the drum 33 may be operated to turn to retract or release the slickline 21 to control the depth of the tool assembly 44. Between the drum 33 and the wellhead 23, the slickline 21 is threaded through a tension sensor 26 (described below) and upper 32 and lower 35 sheaves.

Figure 10:
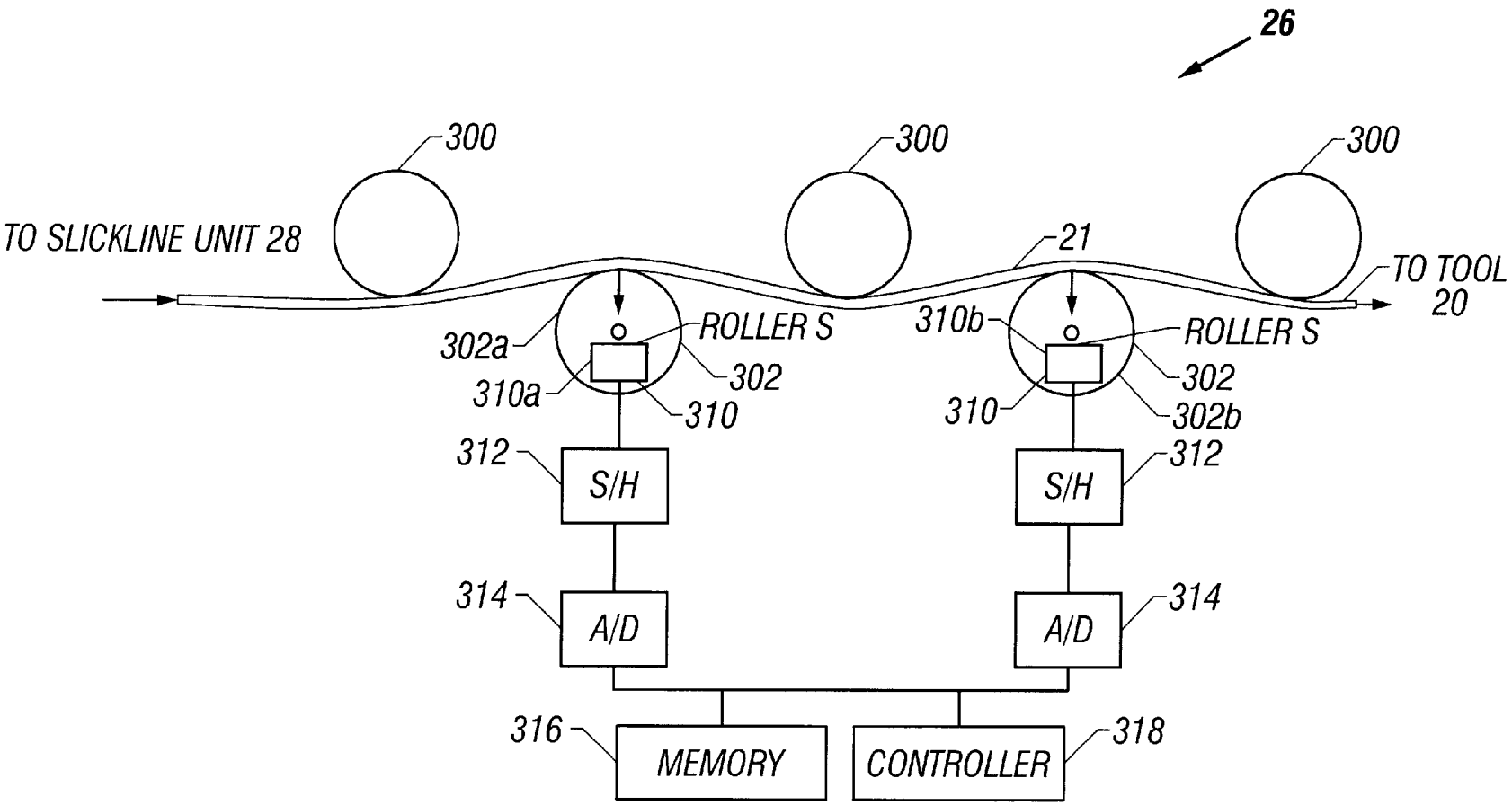
FIG. 10 is a schematic diagram of a tension sensor of the system of FIG. 1 according to an embodiment of the invention.

Referring to FIG. 10, in some embodiments, the tension sensor 26 includes upper rollers 300 and lower rollers 302 (including rollers 302*a* and 302*b*) through which the slickline 21 extends. Sensors 310 are coupled to the lower rollers 302 to detect and indicate (via electrical signals) the downward forces that the slickline 21 exerts on the lower rollers 302*a* and 302*b*. In this manner, a sensor 310*a* detects the force that is exerted on the lower roller 302*a*, and a sensor 310*b* detects the force that is exerted on the lower roller 302*b*. In some embodiments, each sensor 310 produces a signal that is sampled by a separate sample and hold (S/H) circuit 312 that provides the sampled signal to a separate analog-to-digital (A/D) converter 314. Each A/D converter 314 provides a digital signal that indicates the force exerted on its roller 302, and thus, indicates the strain on the slickline 21. Indications of these digital signals are stored in a memory 316. In some embodiments, a controller 318 of the tension sensor 26 may use the indications that are stored in the memory 316 to detect the signature of the pulse 24.

Besides identifying the signature that is associated with the tension pulse 24, the controller 318 may also analyze the indications of the waveforms in the memory 316 to determine the direction of the detected tension pulses. More particularly, a tension pulse may be inadvertently generated as the drum 33 retrieves the tool assembly 44, as the drum 33 may momentarily catch the slickline 21 and generate a tension pulse in the slickline 21. However, this tension pulse propagates in a direction that is opposite from the tension pulse 24. Therefore, by detecting the direction of tension pulses that occur on the slickline 21, the tension sensor 26 may filter out tension pulses that do not originate with the tool 20 and thus, are not tension pulses 24. To accomplish this, an indication of the tension sensed by each sensor 310 is stored separately in the memory 316 so that the controller 318 may analyze the detected tension signals to determine which sensor 310 detected the tension pulse first. Thus, if the sensor 310*a* experiences a tension pulse first, the detected tension pulse originated with the slickline unit 28. However, if the sensor 310*b* experiences a tension pulse first, the tension pulse originated downhole and may be a tension pulse 24.

Figure 11:
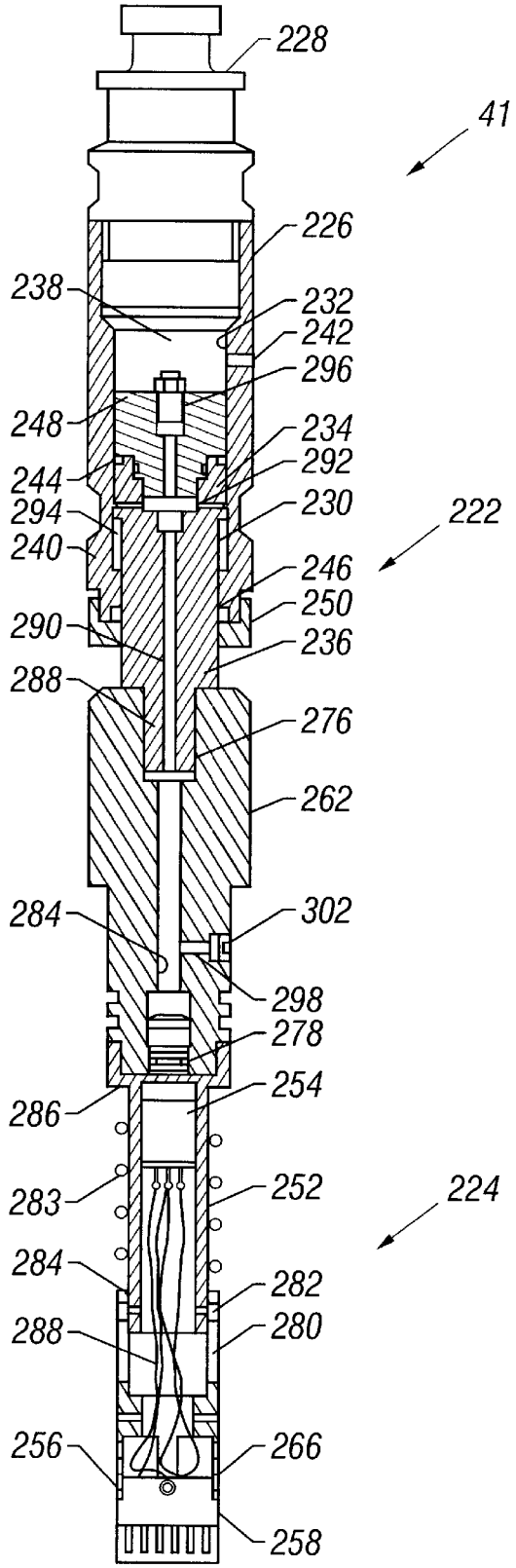
FIG. 11 is a schematic diagram of a hydraulic strain head of the tool according to an embodiment of the invention.

Referring to FIG. 11, in some embodiments, the hydraulic strain head 41 includes a sealed chamber that experiences pressure changes when the tool assembly 44 accelerates either in an upward or downward direction. A pressure-responsive transducer 254 detects the pressure changes and in response, generates electrical signals to indicate the changes and thus, indicate the decoded commands. The hydraulic strain head 41 communicates with the tool 20 through electronics (that are coupled to the electronics 54) to communicate the decoded commands.

The hydraulic strain head 41 includes a hydraulic power section 222 and a sensor section 224. The hydraulic power section 222 includes a cylinder 226. A fishing neck 228 is mounted at the upper end of the cylinder 226 and adapted to be coupled to the drum 33 (see FIG. 1) so that the hydraulic strain head 41 may be lowered into and retrieved from the wellbore via the slickline 21. With the fishing neck 228 coupled to the slickline 21, the hydraulic strain head 41 and other attached components may be accelerated or decelerated by the appropriate movement of the drum 33. The fishing neck 228 may also be coupled to other tools.

A mandrel 230 is disposed in and axially movable within a bore 232 in the cylinder 226. The mandrel 230 has a piston portion 234 and a shaft portion 236. An upper chamber 238 is defined above the piston portion 234, and a lower chamber 240 is defined below the piston portion 234 and around the shaft portion 236. The upper chamber 238 is exposed to the pressure outside the cylinder 226 through a port 242 in the cylinder 226. A sliding seal 244 between the piston portion 234 and the cylinder 226 isolates the upper chamber 238 from the lower chamber 240, and a sliding seal 246 between the shaft portion 234 and the cylinder 226 isolates the lower chamber 240 from the exterior of the cylinder 226. The sliding seal 244 is retained on the piston portion 234 by a seal retaining plug 248, and the sliding seal 246 is secured to a lower end of the cylinder 226 by a seal retaining ring 250.

The sensor section 224 includes a first sleeve 252 which encloses and supports a pressure transducer 254 and a second sleeve 256 that includes an electrical connector 258. The first sleeve 252 is attached to the lower end of a connecting body 262 with a portion of the pressure transducer 254 protruding into a bore 264 in the connecting body 262. An end 266 of the shaft portion 236 extends out of the cylinder 226 into the bore 264 in the connecting body 262. The end 266 of the shaft portion 226 is secured to the connecting body 262 so as to allow the connecting body 262 to move with the mandrel 230. Static seals, e.g., o-ring seals 276 and 278, are arranged between the connecting body 262 and the shaft portion 236 and pressure transducer 254 to contain fluid within the bore 264.

The shaft portion 236 includes a fluid channel 290 that is in communication with the bore 264 in the connecting body 262. The fluid channel 290 opens to a bore 292 in the piston portion 234, and the bore 292 in turn communicates with the lower chamber 240 through ports 294 in the piston portion 234. The bore 292 and ports 294 in the piston portion 234, the fluid channel 290 in the shaft portion 236, and the bore 264 in the connecting body 262 define a pressure path from the lower chamber 240 to the pressure transducer 254. The lower chamber 240 and the pressure path are filled with a pressure-transmitting medium (oil or other incompressible fluid, as examples) through fill ports 296 and 298 in the seal retaining plug 248 and the connecting body 262, respectively. By using both fill ports 296 and 298 to fill the lower chamber 240 and the pressure path, the volume of air trapped in the lower chamber and the pressure path can be minimized. Plugs are provided in the fill ports 296 and 298 to contain fluid in the pressure path and the lower chamber 240.

In operation, the tool assembly 44 is lowered into the wellbore with the lower chamber 240 and pressure path filled with a pressure-transmitting medium. When the tool assembly 44 is accelerated in the upward direction, the total force, $F_{total}$, that is applied to the piston portion 234 by the tool assembly 44 increases and results in a corresponding increase in the pressure, $P_{lc}$, in the lower chamber 240. When the downhole tool assembly 44 is accelerated in the downward direction, the force, $F_{total}$, which is applied to the piston portion 234 by the downhole tool assembly 44 decreases and results in a corresponding decrease in the pressure, $P_{lc}$, in the lower chamber 240. The tool assembly 44 may also be decelerated in either the upward or downward direction to effect similar pressure changes in the lower chamber 240. The pressure changes in the lower chamber 240 are detected by the pressure transducer 254 as pressure pulses. Moving the tool assembly 44 in prescribed patterns will produce pressure pulses which are converted to electrical signals.

When the hydraulic strain head 41 is coupled to the tool 20, the net force, $F_{net}$, resulting from the pressure differential across the piston portion 234 supports the weight of the rest of the tool assembly 44. The net force resulting from the pressure differential across the piston portion 234 can be expressed as:

$$F_{net}=(P_{lc}-P_{uc})\cdot A_{1c} \quad (1)$$

where $P_{1c}$ is the pressure in the lower chamber 240, $P_{uc}$ is the pressure in the upper chamber 238 or the wellbore pressure outside the cylinder 226, $A_{lc}$ is the cross-sectional area of the lower chamber 240.

The total force, $F_{total}$, that is applied to the piston portion 234 by the tool assembly 44 may be expressed as:

$$F_{total}=m_{tool}(g-a)+F_{drag} \quad (2)$$

where "$m_{tool}$" is the mass of the tool assembly 44, "g" is the acceleration due to gravity, "a" is the acceleration of the downhole tool 218, and $F_{drag}$ is the drag force acting on the tool assembly 44. Drag force and acceleration are considered to be positive when acting in the same direction as gravity.

Assuming that the weight of the sensor section 224 and the weight of the connecting body 262 is negligibly small compared to the weight of the tool assembly 44, then the net force, $F_{net}$, resulting from the pressure differential across the piston portion 234 can be equated to the total force, $F_{total}$, applied to the piston portion 234 by the tool assembly 44, and the pressure, $P_{lc}$, in the lower chamber 240 can then be expressed as:

$$P_{lc}=\frac{1}{A_{lc}}[m_{tool}\cdot(g-a)+F_{drag}+P_{uc}\cdot A_{lc}] \quad (3)$$

The expression above demonstrates that the pressure, $P_{lc}$, in the lower chamber 240 changes as the tool assembly 44 is accelerated or decelerated. These pressure changes are transmitted to the pressure transducer 254 through the fluid in the lower chamber 240 and the pressure path. The pressure transducer 254 responds to the pressure changes in the lower chamber 240 and converts them to electrical signals. For a given acceleration or deceleration, the size of a pressure change or pulse can be increased by reducing the cross-sectional area, $A_{lc}$, of the lower chamber 240.

The second sleeve 256 is mounted on the first sleeve 252 and includes slots 280 which are adapted to ride on projecting members 282 on the first sleeve 252. When the slots 280 ride on the projecting members 282, the hydraulic strain head 41 moves relative to the tool assembly 44. A spring 283 connects and biases an upper end 284 of the second sleeve 256 to an outer shoulder 286 on the first sleeve 252. The electrical connector 258 on the second sleeve 252 is connected to the pressure transducer 254 by electrical wires 288. The electrical connector 258 forms a power and communications interface between the pressure transducer 254 and electronic circuitry (not shown) to decode the commands.

If the tool assembly 44 becomes stuck and jars are used to try and free the assembly, the pressure differential across the piston portion 234 can become very high. If the bottom-hole pressure, i.e., the wellbore pressure at the exterior of the tool assembly 44, is close to the pressure rating of the tool assembly 44, then the pressure transducer 254 can potentially be subjected to pressures that are well over its rated operating value. To prevent damage to the pressure transducer 254, the fill plug may be provided with a rupture disc which bursts when the pressure in the lower chamber 240 is above the pressure rating of the pressure transducer 254. When the rupture disc bursts, fluid drains out of the lower chamber 240 and the pressure path, through the fill port 296, and out of the cylinder 226. As the fluid drains out of the lower chamber 240 and the pressure path, the piston portion 234 will move to the lower end of the cylinder 226 until it reaches the end of travel, at which time the hydraulic strain head 41 becomes solid and the highest pressure the pressure transducer 254 will be subjected to is the bottom-hole pressure. Instead of using a rupture disc, a check valve or other pressure responsive member may also be arranged in the fill port 296 to allow fluid to drain out of the lower chamber 240 when necessary. If the tool assembly 44 becomes unstuck, commands can no longer be generated using acceleration or deceleration of the tool assembly 44. However, traditional methods, such as manipulation of surface wellhead controls or movement of the tool assembly 44 over fixed vertical distances in a column of liquid can still be used.

Figure 12:
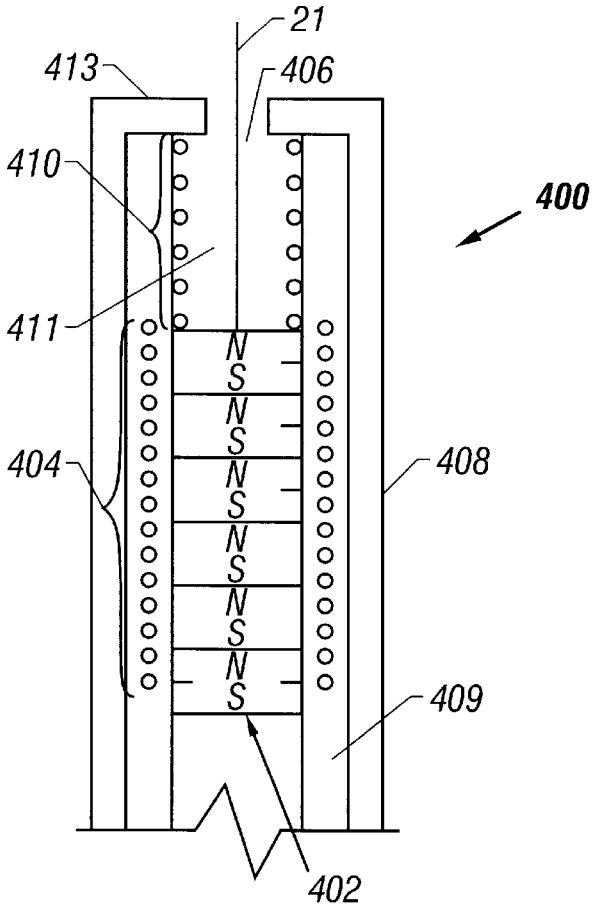

Other embodiments are within the scope of the following claims. For example, other arrangements (hydraulic or electrical, as examples) may be used to generate the tension pulses. As an example, FIG. 12 depicts an embodiment of a tension pulse generator 400 that may be used to at least partially replace the pulse generator that is described above for purpose of generating tension signals on a slickline. The tension pulse generator 400 includes an electromagnetic stator coil 404 to move a shaft 402 that is attached to the slickline 12 and is circumscribed by the coil 404. In some embodiments of the invention, the shaft 402 is formed from stack of permanent magnets. Thus, by controlling the magnetic field that is generated by the coil 404, the shaft 402 may be moved to generate a desired tension signal on the slickline 21. Thus, the coil 404 and shaft 402 form at least part of a linear actuator.

More specifically, in some embodiments of the invention, the electromagnetic stator coil 404 may be aligned with the longitudinal axis of the tool assembly and may be circumscribed by a housing 408 of the tool assembly. As an example, the coil 404 may be encapsulated in a non-ferromagnetic material 409 that forms an inner space 411 in which the shaft 402 slides. The pulse generator 400 includes a coil spring 410 that is located in the space 411 and is compressed between the top surface of the shaft 402 and the lower surface of a cap 413 that extends radially inwardly from the sidewall of the housing 408. The cap 413 includes an opening 406 that receives the slickline 21. The slickline 21 extends along the longitudinal axis of the spring 410 and is attached to the top of the shaft 402.

Figure 13:
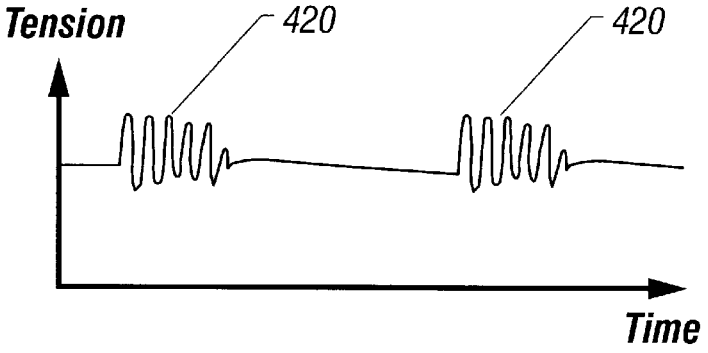
FIG. 13 is a waveform depicting tension of a slickline over time according to an embodiment of the invention.

Thus, due to this arrangement, the polarity and magnitude of current that is received by the coil 404 may be controlled to move the shaft 402 up and down to generate a tension signature on the slickline 21. As an example, FIG. 13 depicts two tension signals 420 that are generated on the slickline 21. Each signal 420 represents a modulated tension on the slickline 21 and is the result of a modulated (frequency modulated, for example) current flowing through the coil 404. In this manner, a terminal voltage of the coil 404 may be modulated to produce the modulated current, that in turns, moves the shaft 402 to generate the tension signal 420. The two signal 420 may be separated in time by a predetermined time interval (an interval of two seconds, for example). Any combination of signatures may be used to indicate detection of a collar.

Figure 14:
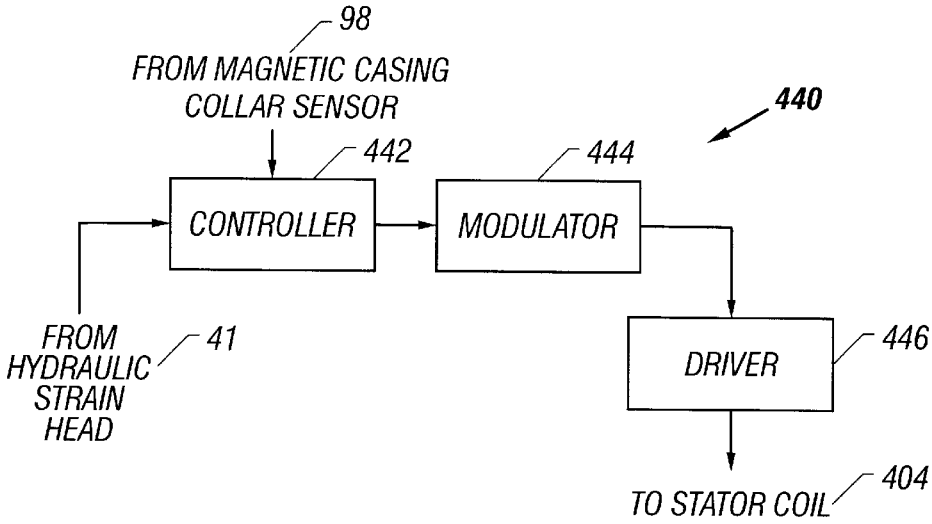
FIG. 14 is a schematic diagram of circuitry to operate the tension pulse generator of FIG. 12 according to an embodiment of the invention.

FIG. 14 depicts circuitry 440 that may be used to control the current in the coil 404. The circuitry 440 includes a controller 442 that receives indications of any detected collars from the magnetic collar sensor 98. The controller 442 also communicates with the hydraulic strain head 41 for purposes of determining when to generate a tension signal in response to a detected collar. When detection of a collar is to be communicated to the surface of the well, the controller 442 momentarily activates a modulator 444 (an frequency modulated (FM) modulator, for example) to generate a modulated voltage that is applied (via a driver 446) to the coil 404 for some predefined time interval. If more than one tension signal is to be generated, the controller 442 may delay for a predefined time interval before activating the modulator 444 to generate the next tension signal on the slickline 21.

Figure 15:
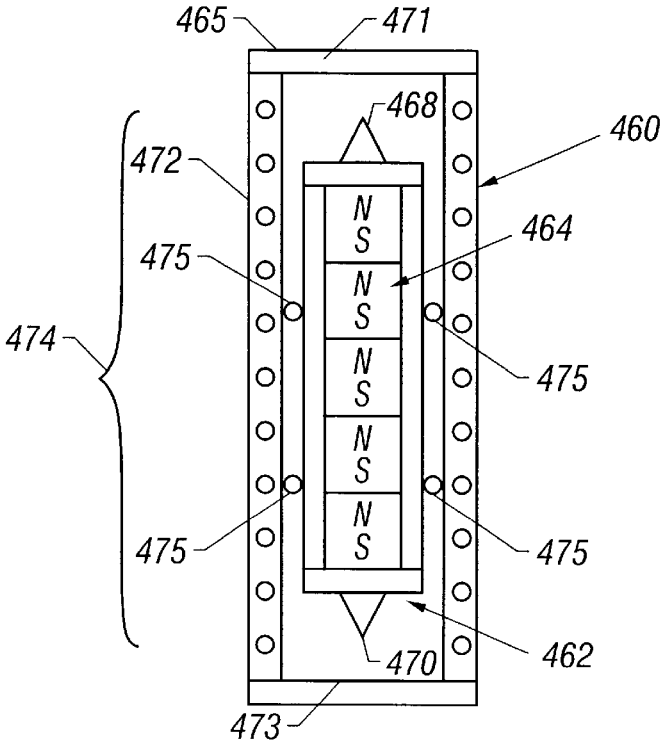
FIGS. 12 and 15 are schematic diagrams of tension pulse generators according to different embodiments of the invention.

Referring to FIG. 15, in some embodiments of the invention, a pulse generator 460 may be used in place of the pulse generators described above. The pulse generator 460 includes a generally cylindrical shaft 462 that extends along the longitudinal axis of the pulse generator 460 and is circumscribed by an electromagnetic coil 474. The electromagnetic coil 474 is encapsulated by a non-ferromagnetic material, such as plastic, that is part of a generally cylindrical housing 472. The housing 472 is attached to the tool assembly and thus, is attached to the slickline 21. The shaft 462 includes a stack 464 of permanent magnets that is enclosed by a non-ferromagnetic (plastic, for example) cylindrical housing 465 of the shaft 462. Upper 468 and lower 470 metal spears are located at the top and bottom, respectively, of the housing 465 and are used to strike upper 471 and lower 473 end caps of the housing 472. The pulse generator 460 may include rollers 475 (plastic rollers, for example) that are located between the outer surface of the housing 465 of the shaft 462 and the inner surface of the housing 472.

Figure 16:
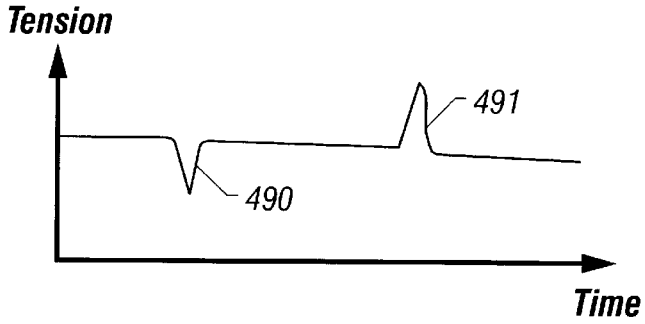
FIG. 16 is a waveform depicting tension of a slickline over time according to an embodiment of the invention.

Thus, due to the above-described arrangement, the current through the coil 474 may be controlled to move the shaft 462 in an upward direction to strike the upper cap 471 to momentarily reduce tension on the slickline 21 in the form of a negative pressure pulse 490 that is depicted in FIG. 16. The current in the coil 474 may also be controlled to move the shaft 462 in a downward direction to strike the lower cap 473 to momentarily increase tension on the slickline 21 in the form of a positive pressure pulse 491. Thus, the coil 474 and shaft 462 form at least part of a linear actuator.

In some embodiments of the invention, the occurrence of a negative pressure pulse 490 that is followed in time by a positive pressure pulse 491 may form a signature to indicate detection of a casing collar. Any combination of the of pulses or signatures may be used to indicate detection of a casing collar.

Figure 17:
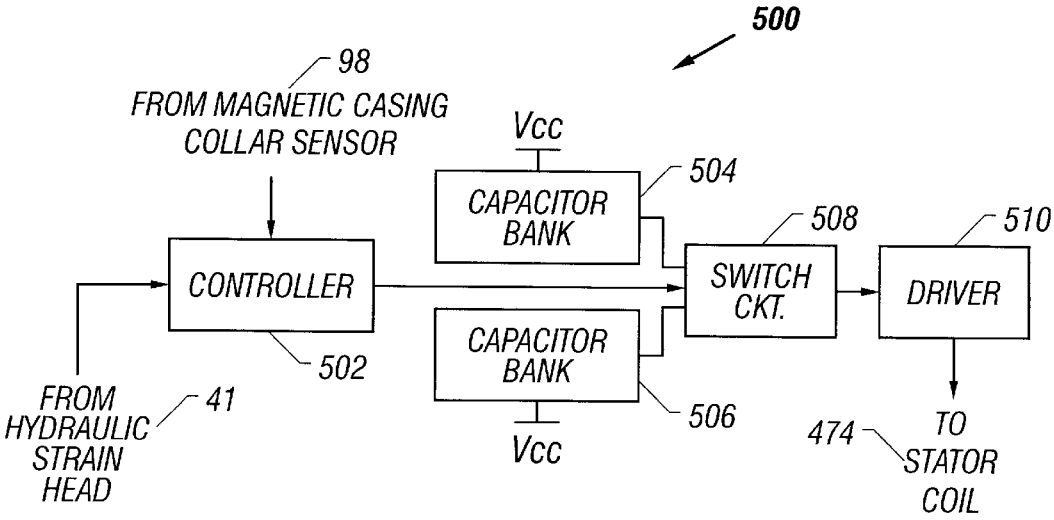
FIG. 17 is a schematic diagram of circuitry to operate the tension pulse generator of FIG. 15 according to an embodiment of the invention.

In some embodiments of the invention, circuitry 500 that is depicted in FIG. 17 may be used to control the current through the coil 474 for purposes of generating the positive and negative tension pulses in the slickline 21. The circuitry 500 may include a controller 502 that receives indications of any detected collars from the magnetic collar sensor 98. The controller 502 also communicates with the hydraulic strain head 41 for purposes of determining when to generate a tension signature in response to a detected collar.

The circuitry 500 may include two capacitor banks 504 and 506 to generate two successive tension pulses. In this manner, each capacitor bank 504, 506 stores energy that is converted into a large current for purposes of producing a large magnetic force (via the coil 474) to propel the shaft 462 into the cap 471 or 473. Because each capacitor bank 504, 506 stores energy at a slower rate than which the capacitor bank 504, 506 delivers the energy to the coil 474, two capacitor banks may be needed to produce two successive tension pulses.

The controller 502 generates a particular tension pulse by controlling a switch circuit 508 (that is coupled to the capacitor banks 504 and 506) to discharge one of the capacitor banks 504 and 506 into the coil 474 via a driver 510. The switch circuit 508 not only selects one of the capacitor banks 504 and 506, the switch circuit 508 also selects the polarity of the voltage that is applied to the coil 474, in some embodiments of the invention.

For example, to generate a negative tension pulse that is followed by a positive tension pulse, the controller 502 may communicate with the switch circuit 508 to select the capacitor bank 504 and set the polarity of the voltage that is applied to the terminal voltage to cause the shaft 462 to slam into the cap 471. In this manner, the capacitor bank 504 discharges to produce the negative tension pulse in the slickline 21. Next, after waiting for some predefined time, the controller 502 communicates with the switch circuit 508 to select the capacitor bank 506 and set the polarity of the voltage that is applied to the terminal voltage to cause the shaft 462 to slam into the cap 473. In this manner, the capacitor bank 506 discharges to produce the positive tension pulse in the slickline 21. The controller 502 may control the movement of the shaft 462 to produce other signatures in other embodiments of the invention.

Other embodiments are within the scope of the following claims. For example, the electromagnetic coil and magnet stack of the pulse generator 400, 406 may be replaced by a tubular linear motor, in some embodiments of the invention. Other variations are possible.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A downhole tool connectable to a line to be run downhole with the tool, the tool comprising:

a housing adapted to be attached to the line;

a sensor adapted to detect a downhole feature; and a mechanism located inside the housing and coupled to the sensor to, in response to the detection of the feature by the sensor, generate a tension signal in the line without physically contacting a downhole structure.

2. The downhole tool of claim 1, wherein the downhole structure comprises a well casing.

3. The downhole tool of claim 1, wherein the feature comprises a casing collar.

4. The downhole tool of claim 1, wherein the tool comprises a slickline tool.

5. The downhole tool of claim 1, wherein the mechanism comprises:

a weight located inside the housing;

a latch adapted to hold the weight and release the weight to generate the tension signal in the line in response to the detection of the feature by the sensor.

6. The downhole tool of claim 5, wherein the latch is adapted to suspend the weight above a surface secured to the housing when the latch holds the weight.

7. The downhole tool of claim 5, further comprising:

a spring adapted to be compressed when the latch holds the weight, the spring exerting a force on the weight when the latch releases the weight.

8. The downhole tool of claim 5, wherein the mechanism further comprises:

a shaft attached to the weight; and a motor, wherein the latch is further adapted to couple the shaft to the motor to allow the motor to move the weight from a surface that the weight strikes when the weight is released and release the shaft in response to the detection of the feature by the sensor to permit the weight to strike the surface.

9. The downhole tool of claim 8, wherein the latch comprises:

a split collar adapted to surround the shaft;

another shaft connected to the split collar; and a solenoid adapted to move said another shaft to cause the split collar to release the shaft in response to the detection of the feature by the sensor.

10. The downhole tool of claim 9, wherein the solenoid is further adapted to move said another shaft to cause the split collar to grab the shaft.

11. The downhole tool of claim 9, wherein the split collar comprises:

two half collars; and at least one compression spring located between said half collars to bias the two half collars apart.

12. The downhole tool of claim 1, wherein the mechanism comprises:

an electromagnetic coil to provide a magnetic field; and a shaft located inside the coil and adapted to respond to the magnetic field to strike a surface attached to the housing to generate the tension signal.

13. The downhole tool of claim 12, wherein the shaft comprises:

a least one permanent magnet.

14. The downhole tool of claim 13, wherein the shaft comprises a spear to strike the surface.

15. The downhole tool of claim 13, wherein the shaft comprises a spear to strike the surface when the shaft travels in a first direction and another spear to strike another surface attached to the housing when the shaft travels in a second direction different than the first direction.

16. The downhole tool of claim 15, wherein the shaft travels in the first direction to strike the surface to generate a positive pressure pulse in the line and travels in the second direction to strike said another surface to generate a negative pressure pulse.

17. The downhole tool of claim 12, further comprising:

a circuit to control a current through the coil to control movement of the shaft.

18. The downhole tool of claim 17, wherein the circuit comprises:

at least one capacitor bank to produce the current.

19. The downhole tool of claim 12, further comprising:

a circuit to control a current through the coil to control movement of the shaft.

20. The downhole tool of claim 19, wherein the circuit comprises:

a modulator to modulate the current to generate the tension signal.

21. The downhole tool of claim 1, wherein the mechanism comprises:

an electromagnetic coil to provide a magnetic field; and a shaft located inside the coil and attached to the line, the shaft adapted to respond to the magnetic field to generate the tension signal in the line.

22. The downhole tool of claim 21, further comprising:

a coil spring attached to the housing and the shaft to exert a bias force on the shaft.

23. The downhole tool of claim 21, wherein the shaft comprises:

a least one permanent magnet.

24. The downhole tool of claim 1, wherein the line comprises a slickline.

25. The downhole tool of claim 1, wherein the line comprises a cable.

26. An apparatus usable with a downhole tool, comprising:

rollers to receive a line extending to the downhole tool, the line capable of communicating a tension pulse that propagates in a direction along the line;

at least one sensor in contact with at least one of the rollers to indicate forces exerted on the rollers by the line; and a circuit adapted to use the indications from said at least one sensor to determine the direction of the propagation of the tension pulse.

27. The apparatus of claim 26, wherein said at least one sensor comprises two sensors, each sensor indicating the force exerted on a different one of the rollers.

28. The apparatus of claim 27, wherein the circuit uses the indications from the two sensors to determine the direction.

29. The apparatus of claim 27, wherein the circuit is further adapted to analyze the tension pulse to determine if the tension pulse originated with the tool.

30. The apparatus of claim 26, wherein the circuit determines if the direction is a direction from the tool.

31. The apparatus of claim 26, wherein the line comprises a slickline.

32. The apparatus of claim 26, wherein the line comprises a cable.

* * * * *